United States Patent [19]

Swart

[11] Patent Number: 4,686,722

[45] Date of Patent: Aug. 18, 1987

[54] ARTICULATED BED WITH CELLULAR AIR CUSHION MATTRESS

[75] Inventor: Maarten E. Swart, Delft, Netherlands

[73] Assignee: Revalidatie Institut Muiderpoort, Amsterdam, Netherlands

[21] Appl. No.: 596,805

[22] Filed: Apr. 4, 1984

[30] Foreign Application Priority Data

Apr. 6, 1983 [NL] Netherlands ..... 8301197

[51] Int. Cl.[4] ..... A47C 27/08; A47C 27/10

[52] U.S. Cl. ..... 5/453; 5/455

[58] Field of Search ..... 5/66, 449, 450, 452–456

[56] References Cited

U.S. PATENT DOCUMENTS

| | | | |
|---|---|---|---|
| 3,330,598 | 7/1967 | Whiteside | 5/453 |
| 3,822,425 | 7/1974 | Scales | 5/456 |
| 4,346,489 | 8/1982 | McMullan | 5/455 |
| 4,394,784 | 7/1983 | Swenson et al. | 5/455 |
| 4,488,322 | 12/1984 | Hunt et al. | 5/455 |

FOREIGN PATENT DOCUMENTS

| | | | |
|---|---|---|---|
| 1545806 | 5/1979 | United Kingdom | 5/455 |

*Primary Examiner*—Gary L. Smith
*Assistant Examiner*—Michael F. Trettel
*Attorney, Agent, or Firm*—John P. Snyder

[57] ABSTRACT

Individual groups of inflatable cushions forming an air mattress are supplied with pressurizing air through a common feed duct having an upstream on/off valve and individual on/off valves in branch ducts leading to individual groups of cushions. When the upstream valve is open, it exhausts pressure air from the branch ducts so that if any one of the branch duct valves is also open, its associated group of cushions are subjected to reduced pressure. The individual valves may be operated to isolate groups of cushions from each other while the upstream valve is closed and thus subject a particular group of cushions to system pressure. A single pressure sensor measures the pressure to which the particular group of cushions is subjected and the whole system may be programmed though a computer for automatic control dependent upon individual user requirements.

7 Claims, 3 Drawing Figures

ARTICULATED BED WITH CELLULAR AIR CUSHION MATTRESS

Figure 1:
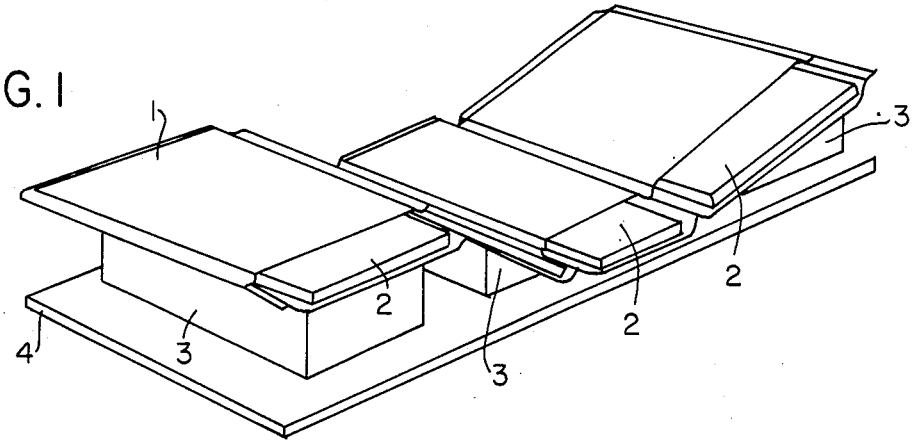

The invention relates to a lying-down support mainly comprising a bottom plate and a plurality of inflatable cushions supported by said plate and connected through a common feed duct with a pressure source.

A lying support of the kind set forth in the preamble is particularly suitable for persons obliged to stay in bed for a long period, which involves the hazards of decubitus. Known lying-down supports for preventing and healing decubitus satisfying the requirements comprise air cushions arranged in sections in a transverse direction. A specific property of these cusions is that through pores and seams they permit air to escape into the atmosphere in order to keep the patient's skin dry. A drawback of such a system is that the escaping air may contain wound damp which gives rise to unhygienic conditions. Moreover, the air-conditioning system, if any, in the patient's room may become disturbed.

With the known lying supports the pressure in the air cushions is set with the aid of a measuring and control-system. This involves the following inconveniences: when the recumbent person changes his position, the pressure in each of the cushions has each time to be reset: in the event of damage one or more air cushions such an amount of air may escape into the atmosphere that the supply becomes insufficient and the properties of the lying support with regard to the prevention of decubitus are lost.

The present invention has for its object to obviate the above-mentioned disanvantages and provides for this purpose a lying support which is distinguished in that each cushion or a group of cushions is substantially gastight and is connected through a branch duct with a common duct. each branch duct being provided with a controlled valve. Thanks to the gastightness of the air cushions the desired pressure in each cushion can be maintained solely through the controlled valve. By regular check of the pressure in each cushion or a group of cushions the control of the valve may take place fully automatically so that at any instant the proper pressure can be maintained. In the event of a position change of the patient a previously introduced programme can be introduced so that the new pressure ratios in the cushions can be very rapidly set.

In one embodiment the common feed duct includes a controlled main valve and is connected at a point after the main valve with a controlled relief valve. By this control all cushions can be very rapidly provided with pressurized air or they can be separately or groupwise be inflated or emptied.

In a preferred embodiment the common feed duct is provided with a pressure sensor.

In order to permit the patient assume more than one recumbent position, a plurality of cushions are united into a section, which is supported by a carrying plate adjustable in a direction of height. In this way a sitting position can be obtained, which has in addition a centering effect of the patient on the bed so that also in a position change the correct pressure is automatically exerted on the correct place of the body.

In the preferred embodiment a pneumatic lifting means is arranged between each carrying plate and the bottom plate, which means is connected through a branch duct including a controlled valve with the common feed duct. In this way the pressure ratios with respect to the lying and sitting positions respectively are automatically obtained.

In order to avoid the notorious, undesirable wave motion experienced by the patient, each air cushion is embedded in a U-shaped support of a foam substance. This support provides in addition a lateral support, which facilitates getting in and out of the bed.

When the air pressure would drop-off unexpected whereupon the cushion will deflate, the foam-support will act like a normal mattress so enhancing safety for the patient.

In order to ensure optimum flexibility of the various cushions relative to one another, the width of the air cushion is equal to that of the U-shaped support. This facilitates in addition cleaning of the lying support.

Figure 2:
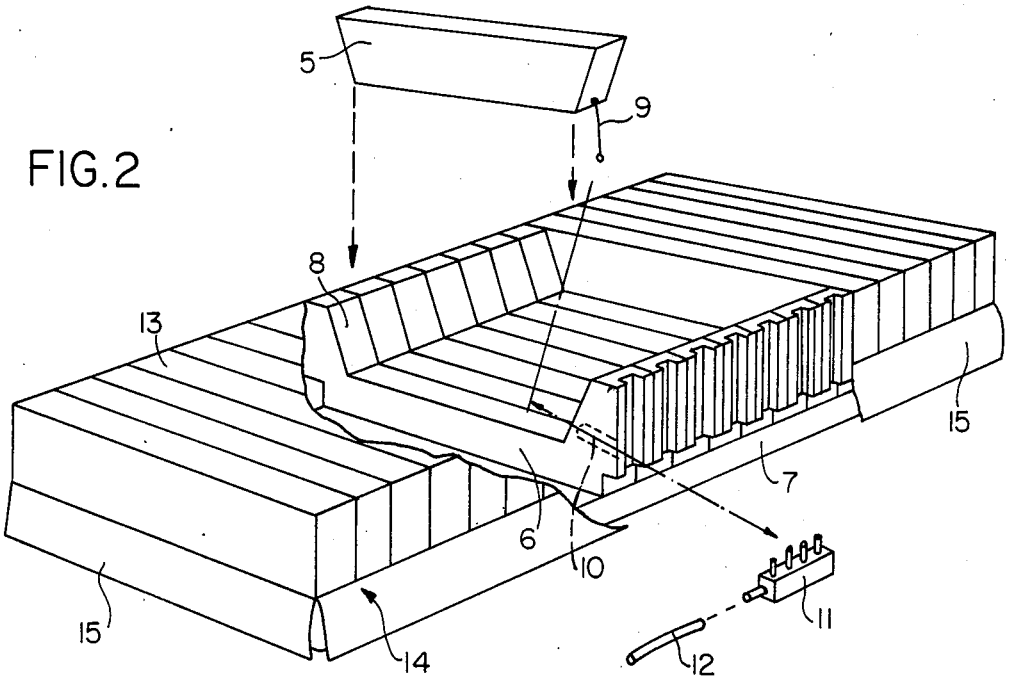
Figure 3:
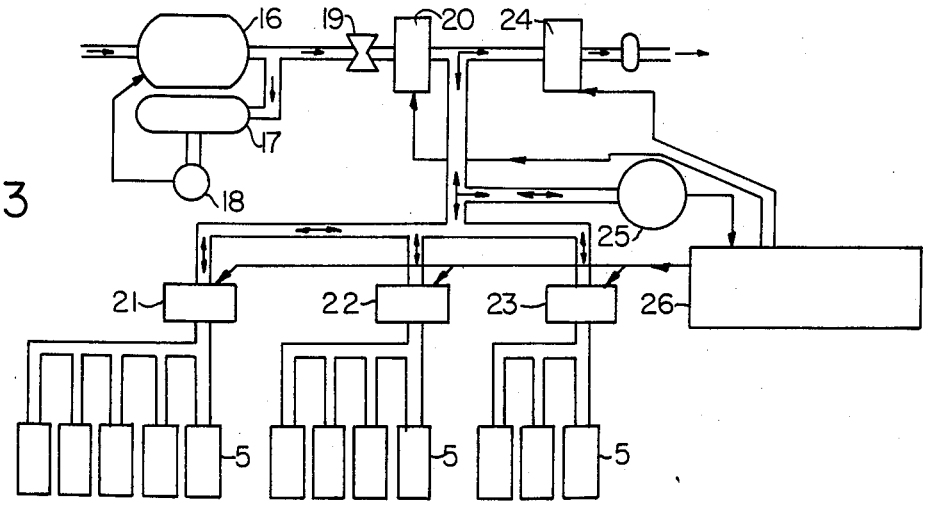

The invention will be described more fully with reference to an embodiment. The drawing shows in:

FIG. 1 a perspective view of the bottom plate with carrying plates adjustable in a direction of height, FIG. 2 a perspective view like FIG. 1 of the air cushions with U-shaped supports adapted to be deposited on the carrying plates of FIG. 1, FIG. 3 a schematic survey of the pneumatic control-system for the lying-down support shown in FIG. 1 and 2.

The lying-down support comprises a base part, elements embedding the air cushions, air cushions, hoses connecting the air cushions (or groups of air cushions) with the pressure measuring and control-system and one or more separation covers holding together the air cushions and the elements embedding the same.

FIG. 1 shows a potential embodiment of the base part. This base part comprises a cover 1 holding:

carrying plates 2, the longitudinal dimensions of which largely correspond to the length of the lower legs, the upper legs, the pelvis and the remaining upper part of the human body, the lifting bellows 3 located below said carrying plates 2; by pumping air into these bellows various sitting positions as well as differing positions of the patient can be obtained, a bottom plate 4, which is arranged below said lifting bellows 3 and provides a stable substrate for these bellows.

FIG. 2 shows a possible embodiment of elements embedding the air cushions, of the air cushions, of the hoses connecting the air cushions (or groups of air cushions) with the measuring and control-system of the separation cover or covers.

The air cushions 5 are embedded, for example, in foam rubber blocks 6, which are connected in turn (for example glued) to the base part 7.

The standing rims 8 of the relatively stiff foam blocks 6 constitute rigid side rims left and right of the bed. These side rims facilitate getting in and out of the bed and can furthermore prevent the patient from sliding out of the bed.

Each air cushion is provided herein on a side with a hose 9 for connection with the pressure measuring and control-system. The pressure measuring and control-system may be arranged in a housing below or at the side of the bed.

In the embodiment shown in FIG. 2 the hoses 9 are guided through the channels 10 towards the side of the lying-down support and then groupwise interconnected by using a collecting block 11. In this way groups of air cushions can be formed. From each collecting block 11 a single hose 12 passes towards the pressure measuring and control-system. As an alternative each hose 9 may be prolonged up to the pressure measuring and control-system, after which the groups are formed.

The air cushion 5 and the foam rubber block 6 can be held together by a cover. It is not necessary to provide each combination of cushion and foam rubber block with a separate cover. The construction of the cover 13 from a single piece of material has the advantage that gutters 14 are formed between the air cushions for collecting any incontinency moisture, detergents and so on and conducting the same away towards the side of the lying-down support.

In order to protect the bed frame against soiling and to cover the hose 9, 12 flaps 15 may be provided on the left and right-hand side of the bed.

The pressure measuring and control-system is shown in FIG. 3 It is designed so that an expert can set for each patient and for each position of the body the pressures in the separate air cushions (or in the separate groups of air cushions) and lifting bellows. The pressure sequences are then stored in a computer memory and then they can be set for each body position by the nurse or the patient himself.

The operation of the pressure measuring and control-system: Compressor 16, stock vessel 17, pressure switch 18, adjustable reducing valve 19 constantly offer pressurized air of 1 to 2 atms. to the input of valve 20. If the pressure has to be raised in one of the lifting bellows or in one of the air cushions, valve 20 as well as one of the valves 21, 22 or 23 opens.

If the pressure has to be lowered in one of the lifting bellows or in one of the air cushions, valve 24 as well as one of the valves 21, 22 or 23 opens.

If the pressure has to be measured in one of the lifting bellows or in one of the air cushions, all valves are closed with the exception of the valves 21, 22 or 23. The computer obtains the pressure information from the pressure sensor 25.

The above-mentioned (magnetic) valves are actuated by the micro-computer when:

1. the patient or the nurse inform the microcomputer 26 of a change of body position and the computer states that the pressures of the lifting bellows or air cushions associated with the new position differ from the pressures associated with the earlier position; the "correct" pressures are—as stated above—stored by the expert in the computer memory.

2. the computer states during a fully automatic, periodic check, that the pressures of the lifting bellows or air cushions differ from the corresponding pressures stored in the memory.

Thanks to the above-described measuring and control-system the lying-down support can match patients of highly different body lengths and various recumbent positions, since given cushions can be without pressure for short lengths of the body. Centering of the patient takes place automatically when he is brought into a sitting position, in which case the pelvis gets inself at the pelvis-support.

What is claimed is:

1. A bed comprising a base plate and a plurality of inflatable cushions supported transversely on said base plate along the length of the bed and cumulatively defining the body-supporting surface of the bed, said cushions being impervious to the passage of gas therethrough; and means for maintaining gas under pressure internally of said cushions, said means comprising:

a gas pressure feed source;

a common feed duct connected to said feed source;

a plurality of branch ducts connected to said common feed duct and connected to distribute gas from said common feed duct to said inflatable cushions;

a first on/off valve in each of said branch ducts whereby different ones of said cushions may be maintained at different pressures by isolating at least some of said branch ducts from each other;

a pressure reducing valve in said common feed duct for controlling the pressure of gas supplied by said feed source to said branch ducts;

a second on/off valve in said common feed duct upstream of said branch ducts for exhausting gas, when open, from those cushions connected to branch ducts whose first on/off valves are also open and, when closed, for providing a supply of pressurized gas through said pressure reducing valve to the branch ducts and to those cushions whose first on/off valves are also open; and a pressure sensor in said common feed duct.

2. A bed as defined in claim 1 including a plurality of carrying plates, means supporting each carrying plate on said base plate for vertical adjustment relative thereto, and support means on each of said carrying plates for supporting a group of said cushions thereon.

3. A bed as defined in claim 2 wherein one branch duct is provided for each group of said cushions.

4. The bed as defined in claim 2 wherein said means supporting each carrying plate on said base plate comprises an inflatable member for each carrying plate each connected through one of said branch ducts and an associated first on/off valve to said common feed duct.

5. A bed as defined in claim 2 wherein said support means comprises a series of generally U-shaped supports, each cushion being of keystone shape and nested snugly in an associated U-shaped support, each U-shaped support being or relatively rigid foam material.

6. A bed as defined in claim 5 wherein each u-shaped support and its associated cushion are of the same width.

7. An articulated bed comprising a base plate and a series of carrying plates disposed thereon, means for raising and lowering said carying plates individually with respect to said base plate, and cellular mattress means carried by said carrying plates for articulation therewith, said cellular mattress means comprising a section carried by each carrying plate, each section comprising a sequence of relatively rigid supports each having an inverted trapezoidal recess and a keystone shaped inflatable cushion received in said recess, air pressure source means for continuously supplying air under pressure, duct means for supplying pressurized air for the cushions of each section, first on/off valve means in said duct means for selectively supplying pressurized air to each section independently of the other sections, second on/off valve means cooperating with said first on/off valve means for exhausting pressurized air from each section independently of the other sections, a pressure sensor in said duct means upstream of said second on/off valve means, and means connected to said pressure sensor for programmable actuation of said first and second on/off valve means to adjust the relative pressures among said sections.

* * * * *